US011752589B2

(12) United States Patent
Soundararajan et al.

(10) Patent No.: US 11,752,589 B2
(45) Date of Patent: Sep. 12, 2023

(54) CHEMICAL MECHANICAL POLISHING TEMPERATURE SCANNING APPARATUS FOR TEMPERATURE CONTROL

(71) Applicant: Applied Materials, Inc., Santa Clara, CA (US)

(72) Inventors: Hari Soundararajan, Sunnyvale, CA (US); Shou-Sung Chang, Mountain View, CA (US); Haosheng Wu, San Jose, CA (US); Jianshe Tang, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 576 days.

(21) Appl. No.: 16/849,863

(22) Filed: Apr. 15, 2020

(65) Prior Publication Data

US 2020/0331113 A1 Oct. 22, 2020

Related U.S. Application Data

(60) Provisional application No. 62/835,990, filed on Apr. 18, 2019.

(51) Int. Cl.
*B24B 37/015* (2012.01)
*B24B 37/10* (2012.01)
(Continued)

(52) U.S. Cl.
CPC ..... *B24B 37/015* (2013.01); *B24B 37/105* (2013.01); *B24B 37/22* (2013.01);
(Continued)

(58) Field of Classification Search
CPC ..... B24B 37/015; B24B 37/105; B24B 37/22
(Continued)

(56) References Cited

U.S. PATENT DOCUMENTS 5,722,875 A 3/1998 Iwashita et al.
5,851,135 A 12/1998 Sandhu et al.
(Continued)

FOREIGN PATENT DOCUMENTS

CN 103978421 8/2014
CN 105659363 6/2016
(Continued)

OTHER PUBLICATIONS

Office Action in Taiwanese Appln. No. 109112282, dated Jul. 15, 2021, 12 pages (with English summary).
(Continued)

*Primary Examiner* — Joel D Crandall
*Assistant Examiner* — Shantese L McDonald
(74) *Attorney, Agent, or Firm* — Fish & Richardson P.C.

(57) ABSTRACT

A chemical mechanical polishing apparatus includes a platen having a top surface to hold a polishing pad, a carrier head to hold a substrate against a polishing surface of the polishing pad during a polishing process, and a temperature monitoring system. The temperature monitoring system includes a non-contact thermal sensor positioned above the platen that has a field of view of a portion of the polishing pad on the platen. The sensor is rotatable by the motor around an axis of rotation so as to move the field of view across the polishing pad.

19 Claims, 4 Drawing Sheets

(51) Int. Cl.

| | |
|---|---|
| ***B24B 37/22*** | (2012.01) |
| ***B24B 37/34*** | (2012.01) |
| ***B24B 55/02*** | (2006.01) |
| *B24B 49/14* | (2006.01) |
| *B24B 37/04* | (2012.01) |
| *B24B 53/017* | (2012.01) |

(52) U.S. Cl.
CPC ..... *B24B 37/34* (2013.01); *B24B 55/02* (2013.01); *B24B 37/042* (2013.01); *B24B 49/14* (2013.01); *B24B 53/017* (2013.01)

(58) Field of Classification Search
USPC ..... 451/7, 6, 41, 56, 57, 521
See application file for complete search history.

(56) References Cited

U.S. PATENT DOCUMENTS

| | | | | |
|---|---|---|---|---|
| 5,873,769 | A | 2/1999 | Chiou et al. | |
| 5,957,750 | A | 9/1999 | Brunelli | |
| 6,102,776 | A | 8/2000 | Boggs et al. | |
| 6,120,347 | A | 9/2000 | Sandhu et al. | |
| 6,494,765 | B2 | 12/2002 | Gitis et al. | |
| 6,872,132 | B2 * | 3/2005 | Elledge | B24B 49/003 451/6 |
| 6,951,503 | B1 * | 10/2005 | Gotkis | B24B 37/005 451/21 |
| 9,156,122 | B2 * | 10/2015 | Shinozaki | B24B 53/017 |
| 2001/0001755 | A1 | 5/2001 | Sandhu et al. | |
| 2005/0118839 | A1 | 6/2005 | Chen | |
| 2007/0042675 | A1 | 2/2007 | Benvegnu et al. | |
| 2007/0238395 | A1 | 10/2007 | Kimura et al. | |
| 2010/0035518 | A1 * | 2/2010 | Chang | B24B 37/042 451/6 |
| 2010/0151771 | A1 * | 6/2010 | Nabeya | B24B 37/015 451/7 |
| 2012/0034846 | A1 | 2/2012 | Minamihaba | |
| 2012/0190273 | A1 | 7/2012 | Ono et al. | |
| 2013/0023186 | A1 | 1/2013 | Motoshima et al. | |
| 2014/0020829 | A1 | 1/2014 | Chen et al. | |
| 2016/0184960 | A1 | 6/2016 | Matsuo et al. | |
| 2017/0232572 | A1 | 8/2017 | Brown | |
| 2017/0239778 | A1 * | 8/2017 | Maruyama | B24B 37/20 |
| 2018/0236631 | A1 | 8/2018 | Eto et al. | |
| 2019/0143476 | A1 | 5/2019 | Wu et al. | |

FOREIGN PATENT DOCUMENTS

| | | |
|---|---|---|
| CN | 107097145 | 8/2017 |
| CN | 109500726 | 3/2019 |
| KR | 10-2013-0010844 | 1/2013 |
| TW | 201624551 | 7/2016 |
| TW | 201834790 | 10/2018 |

OTHER PUBLICATIONS

PCT International Search Report and Written Opinion in International Appln. No. PCT/US2020/028323, dated Aug. 5, 2020, 11 pages.

Office Action in Chinese Appln. No. 202080041893.8, dated Feb. 11, 2023, 13 pages (with English translation).

Yuan et al., "In-line measurement of CMP polishing interface temperature," Combined machine tools and automated machining technology, Aug. 31, 2016, 8:42-45(abstract only).

* cited by examiner

CHEMICAL MECHANICAL POLISHING TEMPERATURE SCANNING APPARATUS FOR TEMPERATURE CONTROL

CROSS-REFERENCE TO RELATED APPLICATIONS

This application priority to U.S. application Ser. No. 62/835,990, filed on Apr. 18, 2019, the disclosure of which is incorporated by reference.

TECHNICAL FIELD

The present disclosure relates to chemical mechanical polishing (CMP), and more specifically to temperature control during chemical mechanical polishing.

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

SUMMARY

In one aspect, a chemical mechanical polishing apparatus includes a platen having a top surface to hold a polishing pad, a carrier head to hold a substrate against a polishing surface of the polishing pad during a polishing process, and a temperature monitoring system. The temperature monitoring system includes a non-contact thermal sensor positioned above the platen that has a field of view of a portion of the polishing pad on the platen. The sensor is rotatable by the motor around an axis of rotation so as to move the field of view across the polishing pad.

Implementations of any of the above aspects may include one or more of the following features.

The thermal sensor can be rotatable about an axis parallel to the polishing surface.

A rotatable sensor support can be coupled to the motor such that rotation of the support by the motor rotates the sensor. The sensor support can include an arm that extends over the polishing pad. The sensor support can be rotatable about a longitudinal axis of the sensor support. The thermal sensor can be rotatable about an axis perpendicular to the longitudinal axis of the support. The thermal sensor can be movable along the support.

The temperature monitoring system can be configured to measure a temperature of the portion of the polishing pad.

A controller can be coupled to the motor and the temperature monitoring system. The controller can be configured to control the motor so as to cause the thermal sensor to make measurements at a plurality of positions on the polishing pad.

The controller can be configured to generate a temperature profile of the polishing pad based on measurements at the plurality of positions on the polishing pad. The chemical mechanical polishing apparatus can include a heater and/or cooler. The controller can be configured to adjust operation of the heater and/or cooler based on the temperature profile so as to improve temperature uniformity of the polishing pad. The temperature profile can be a radial profile. The temperature profile can be an angular profile about an axis of rotation of the platen. The temperature profile can be a 2D profile.

The thermal sensor can be positioned above an axis of rotation of the platen. The axis of rotation of the thermal sensor can be parallel to the axis of rotation of the platen. The axis of rotation of the thermal sensor can be parallel to the polishing surface.

In another aspect, a method of monitoring a temperature of a polishing pad in a chemical mechanical polishing system includes rotating a thermal sensor about an axis of rotation such that a field of view of the thermal sensor sweeps across a polishing surface of a chemical mechanical polishing pad while the thermal sensor remains laterally stationary, and as the field of view sweeps across the polishing pad, making a plurality of measurements with the thermal sensor to generate a temperature profile.

Implementations of any of the above aspects may include one or more of the following features.

The axis of rotation can be parallel to the polishing surface.

The axis of rotation can be perpendicular to the polishing surface.

Possible advantages may include, but are not limited to, one or more of the following. Temperature changes and variations across the polishing pad can be monitored without requiring lateral translation of a thermal sensor. This can permit monitoring in a crowded polishing station or provide space for additional components in the polishing station. In addition, the temperature at multiple radial positions on the polishing pad can be monitored without contacting the polishing pad. A controller can use the measured temperatures to reduce temperature variation during a polishing operation. This can improve predictability of polishing during the polishing process and improve within-wafer uniformity.

DETAILED DESCRIPTION

Chemical mechanical polishing operates by a combination of mechanical abrasion and chemical etching at the interface between the substrate, polishing liquid, and polishing pad. During the polishing process, a significant amount of heat is generated due to friction between the surface of the substrate and the polishing pad. In addition, some processes also include an in-situ pad conditioning step in which a conditioning disk, e.g., a disk coated with abrasive diamond particles, is pressed against the rotating polishing pad to condition and texture the polishing pad surface. The abrasion of the conditioning process can also generate heat. For example, in a typical one minute copper CMP process with a nominal downforce pressure of 2 psi and removal rate of 8000 Å/min, the surface temperature of a polyurethane polishing pad can rise by about 30° C.

Both the chemical-related variables in a CMP process, e.g., as the initiation and rates of the participating reactions, and the mechanical-related variables, e.g., the surface friction coefficient and viscoelasticity of the polishing pad, are strongly temperature dependent. Consequently, variation in the surface temperature of the polishing pad can result in changes in removal rate, polishing uniformity, erosion, dishing, and residue. By more tightly controlling the temperature of the surface of the polishing pad during polishing, variation in temperature can be reduced, and polishing performance, e.g., as measured by within-wafer non-uniformity or wafer-to-wafer non-uniformity, can be improved.

To more tightly control the temperature of the surface of the polishing pad during polishing and to reduce temperature variation, it is desirable to monitor the temperature of the surface of the polishing pad. Monitoring of the temperature can be done with a thermal sensor, and a temperature profile of the polishing pad, e.g., a radial temperature profile, can be generated from the thermal readings at different portions of the polishing pad performed by the thermal sensor.

In addition, due to the number of physical components that need to be positioned in contact with and moved relative to the polishing pad, e.g., the carrier head, slurry dispenser, temperature control system, etc., placement of a thermal sensor adjacent the polishing pad may be impractical. However, rather than a thermal sensor that is configured to sweep across the polishing pad, a thermal sensor can be operable to rotate from a fixed lateral position to sweep a field of view across the polishing pad. Such a configuration can take up less space and be easier to operate in the presence of other equipment above the polishing pad, such as the carrier head and slurry dispensing arm.

Figure 1A:
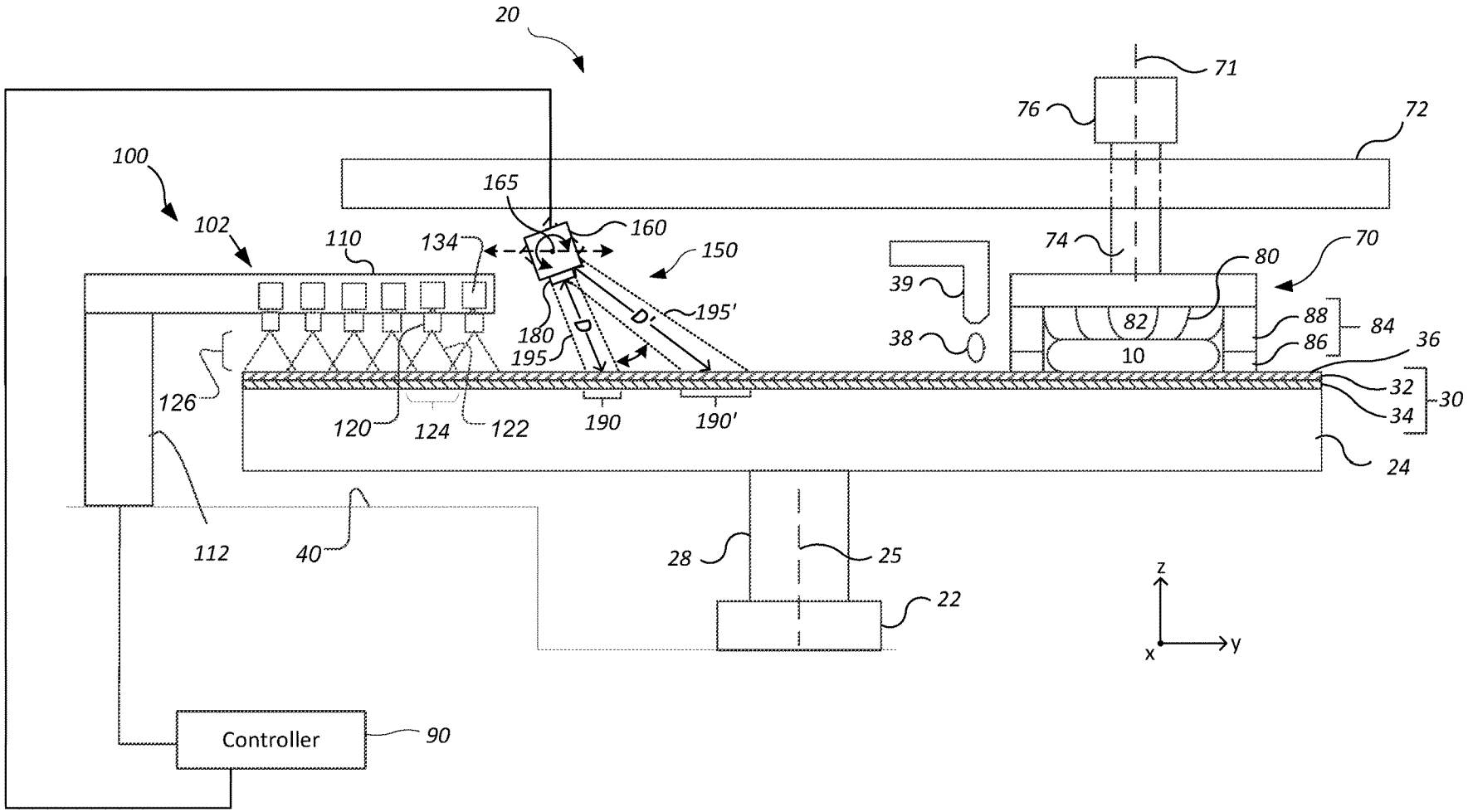
FIG. 1A is a schematic cross-sectional view of an example polishing apparatus.
Figure 1B:
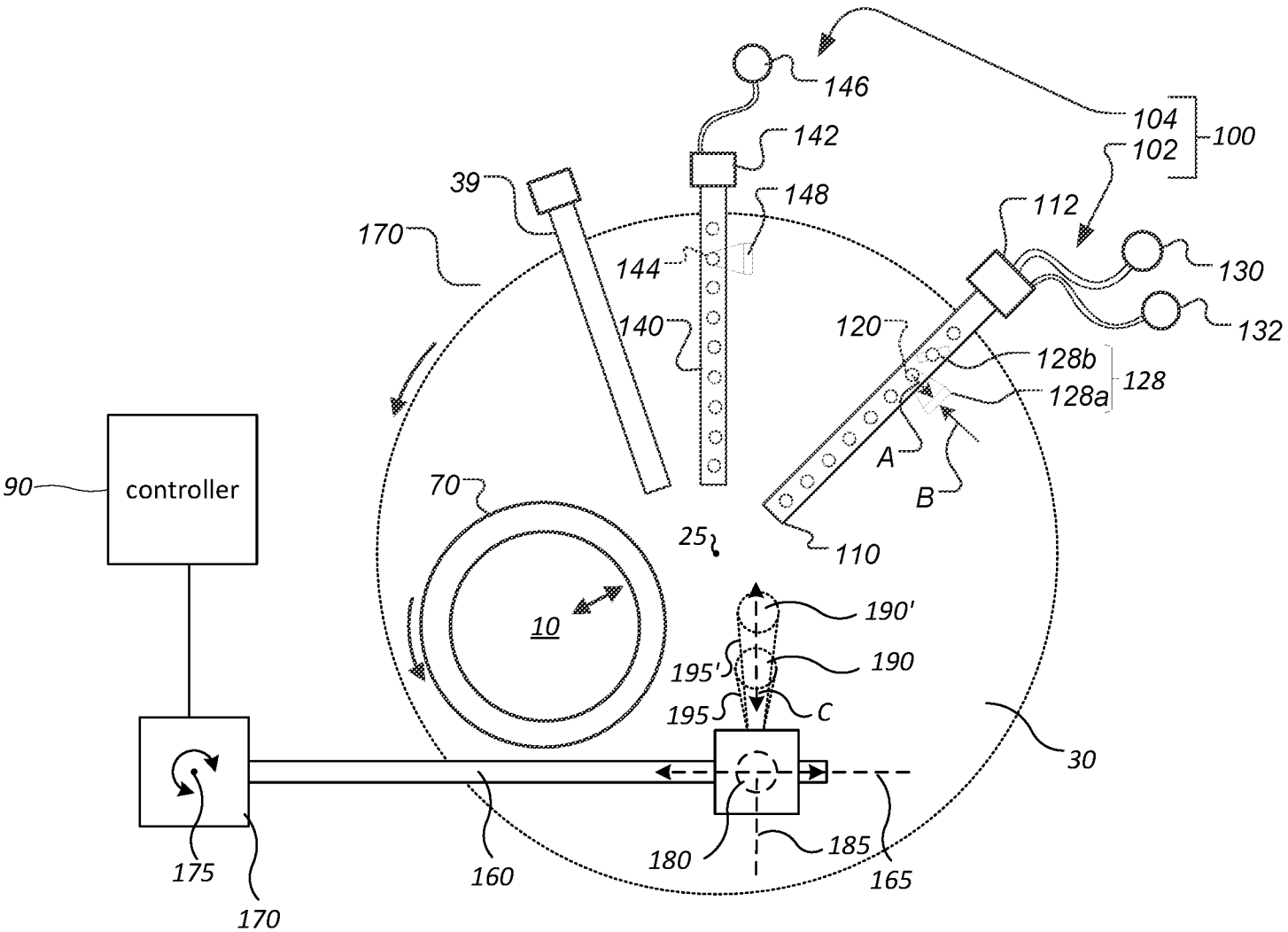
FIG. 1B is a schematic top view of the example polishing apparatus of FIG. 1A.

FIGS. 1A and 1B illustrate an example of a polishing station 20 of a chemical mechanical polishing system. The polishing station 20 includes a rotatable disk-shaped platen 24 on which a polishing pad 30 is situated. The platen 24 is operable to rotate about an axis 25. For example, a motor 22 can turn a drive shaft 28 to rotate the platen 24. The polishing pad 30 can be a two-layer polishing pad with an outer polishing layer 34 and a softer backing layer 32.

The polishing station 20 can include a supply port, e.g., at the end of a slurry supply arm 39, to dispense a polishing liquid 38, such as an abrasive slurry, onto the polishing pad 30. The polishing station 20 can include a pad conditioner apparatus 90 with a conditioning disk 92 (see FIG. 2) to maintain the surface roughness of the polishing pad 30. The conditioning disk 90 can be positioned at the end of an arm 94 that can swing so as to sweep the disk 90 radially across the polishing pad 30.

A carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel, by movement along the track, or by rotational oscillation of the carousel itself.

The carrier head 70 can include a retaining ring 84 to hold the substrate. In some implementations, the retaining ring 84 may include a lower plastic portion 86 that contacts the polishing pad, and an upper portion 88 of a harder material.

In operation, the platen is rotated about its central axis 25, and the carrier head is rotated about its central axis 71 and translated laterally across the top surface of the polishing pad 30.

The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head can also include a retaining ring 84 to hold the substrate.

The polishing system 20 also includes a temperature control system 100 to control the temperature of the polishing pad 30 and/or slurry 38 on the polishing pad. The temperature control system 100 can include a cooling system 102 and/or a heating system 104. At least one, and in some implementations both, of the cooling system 102 and heating system 104 operate by delivering a temperature-controlled medium, e.g., a liquid, vapor or spray, onto the polishing surface 36 of the polishing pad 30 (or onto a polishing liquid that is already present on the polishing pad). Alternatively, at least one, and in some implementations both, of the cooling system 102 and heating system 104 operate by using a temperature-controlled plate that contacts the polishing pad to modify the temperature of the polishing pad by conduction. For example, the heating system 104 can use a hot plate, e.g., a plate with resistance heating or a plate with channels that carry a heating liquid. For example, the cooling system 102 can use a cold plate, e.g., a thermoelectric plate or a plate with channels that carry coolant liquid.

As shown in FIGS. 1A and 1B, an example cooling system 102 includes an arm 110 that extends over the platen 24 and polishing pad 30 from an edge of the polishing pad to or at least near the center of polishing pad 30. The arm 110 can be supported by a base 112, and the base 112 can be supported on the same frame 40 as the platen 24. The base 112 can include one or more actuators, e.g., a linear actuator to raise or lower the arm 110, and/or a rotational actuator to swing the arm 110 laterally over the platen 24. The arm 110 is positioned to avoid colliding with other hardware components such as the polishing head 70, the slurry dispensing arm 39, and the temperature monitoring system 150 (discussed below).

The example cooling system 102 includes multiple nozzles 120 suspended from the arm 110. Each nozzle 120 is configured to spray a liquid coolant medium, e.g., water, onto the polishing pad 30. The arm 110 can be supported by a base 112 so that the nozzles 120 are separated from the polishing pad 30 by a gap 126.

Each nozzle 120 can be configured to direct aerosolized water in a spray 122 toward the polishing pad 30. The cooling system 102 can include a source 130 of liquid coolant medium and a gas source 132 (see FIG. 1B). Liquid from the source 130 and gas from the source 132 can be mixed in a mixing chamber 134 (see FIG. 1A), e.g., in or on the arm 110, before being directed through the nozzle 120 to form the spray 122.

In some implementations, a process parameter, e.g., flow rate, pressure, temperature, and/or mixing ratio of liquid to gas, can be independently controlled for each nozzle. For example, the coolant for each nozzle 120 can flow through an independently controllable chiller to independently control the temperature of the spray. As another example, a separate pair of pumps, one for the gas and one for the liquid, can be connected to each nozzle such that the flow rate, pressure and mixing ratio of the gas and liquid can be independently controlled for each nozzle.

For the heating system 104, the heating medium can be a gas, e.g., steam or heated air, or a liquid, e.g., heated water, or a combination of gas and liquid. The medium is above room temperature, e.g., at 40-120° C., e.g., at 90-110° C. The medium can be water, such as substantially pure deionized water, or water that includes additives or chemicals. In some implementations, the heating system 104 uses a spray of steam. The steam can includes additives or chemicals.

The heating medium can be delivered by flowing through apertures, e.g., holes or slots, e.g., provided by one or more nozzles, on a heating delivery arm. The apertures can be provided by a manifold that is connected to a source of the heating medium.

An example heating system 104 includes an arm 140 that extends over the platen 24 and polishing pad 30 from an edge of the polishing pad to or at least near (e.g., within 5% of the total radius of the polishing pad) the center of polishing pad 30. The arm 140 can be supported by a base 142, and the base 142 can be supported on the same frame 40 as the platen 24. The base 142 can include one or more an actuators, e.g., a linear actuator to raise or lower the arm 140, and/or a rotational actuator to swing the arm 140 laterally over the platen 24. The arm 140 is positioned to avoid colliding with other hardware components such as the polishing head 70, pad conditioning disk 92, and the slurry dispensing arm 39.

Multiple openings 144 are formed in the bottom surface of the arm 140. Each opening 144 is configured to direct a gas or vapor, e.g., steam, onto the polishing pad 30. The arm 140 can be supported by a base 142 so that the openings 144 are separated from the polishing pad 30 by a gap. In particular, the gap can be selected such that the heat of the heating fluid does not significantly dissipate before the fluid reaches the polishing pad. For example, the gap can be selected such that steam emitted from the openings does not condense before reaching the polishing pad.

The heating system 104 can include a source 146 of steam, which can be connected to the arm 140 by tubing. Each opening 144 can be configured to direct steam toward the polishing pad 30.

In some implementations, a process parameter, e.g., flow rate, pressure, temperature, and/or mixing ratio of liquid to gas, can be independently controlled for each nozzle. For example, the fluid for each opening 144 can flow through an independently controllable heater to independently control the temperature of the heating fluid, e.g., the temperature of the steam.

FIG. 1B illustrates separate arms for each subsystem, e.g., the heating system 102, cooling system 104 and rinse system 106, various subsystems can be included in a single assembly supported by a common arm. For example, an assembly can include a cooling module, a rinse module, a heating module, a slurry delivery module, and optionally a wiper module. Each module can include a body, e.g., an arcuate body, that can be secured to a common mounting plate, and the common mounting plate can be secured at the end of an arm so that the assembly is positioned over the polishing pad 30. Various fluid delivery components, e.g., tubing, passages, etc., can extend inside each body. In some implementations, the modules are separately detachable from the mounting plate. Each module can have similar components to carry out the functions of the arm of the associated system described above.

Referring to FIGS. 1A and 1B, the polishing station 20 has a temperature monitoring system 150. The temperature monitoring system 100 includes a thermal sensor 180 positioned above the polishing pad 30. The thermal sensor 180 has a field of view 195 of a portion 190 of the polishing pad 30. In addition, the thermal sensor 180 is movable to change the portion of the pad being monitored. In particular, the thermal sensor 180 can be rotatable so as to sweep the field of view 195 across different portions of the polishing pad 30.

In some implementations, the thermal sensor 180 is configured to generate a signal with a temperature measurement for the portion 190 being monitored, e.g., the sensor is measuring an aggregate temperature of the portion. By shifting the field of view 195 of the thermal sensor 180 to make measurements at multiple locations, the temperature monitoring system 150 can generate a temperature profile of the polishing pad 30. In particular, by sweeping the field of view 195 of the thermal sensor 180 across the polishing pad 30, the thermal sensor 180 can measure the temperature of different regions of the polishing pad 30.

The measurements can be made at a plurality of non-overlapping portions of the polishing pad. Alternatively, measurements can be made a plurality of overlapping portions. In the latter case, a controller can determine temperature of regions that are smaller than the field of view by comparing measurements of adjacent and overlapping portions to determine relative contributions to temperature from the different regions.

The thermal sensor 180 can be a non-contact sensor, such as an infrared sensor, a thermal imaging sensor, a pyrometer, a thermopile detector, a pyroelectrical detector, a bolometer, etc.

The portion 190 can be 1 mm to 10 mm across, e.g., in diameter for a circular portion. The dimensions of the portion 190 can depend on how close the thermal sensor is to the polishing pad 30 (e.g., the z-axis separation as illustrated in FIG. 1A), the angular spread of the field of view 195 of the thermal sensor 180, and the rotation rate of the platen.

The thermal sensor 180 can be supported by a sensor support 160. In some implementations, the sensor support 160 can be an arm that can be positioned above the polishing pad 30. In some implementations, the sensor support 160 for the thermal sensor 180 is attached to or provided by other features of the system 20, such as the support 72.

As shown in FIGS. 1A and 1B, the sensor support 160 or the sensor 180 is rotatable about an axis of rotation 165 that is parallel to the top surface of the platen 24 (and to the polishing surface 36). This sweeps the field of view 195 of the sensor 180 in a direction perpendicular to the axis of rotation 165. For example, an arm that serves as the sensor support 160 could be rotatable by a motor 170, or the sensor 180 could be secured to the sensor support 160 by an actuator. This permits the thermal sensor 180 to rotate to view different portions 190 at different radial positions on the polishing pad 30. In particular, the field of view can sweep across the polishing pad 30 while the thermal sensor 180 remains laterally stationary.

Assuming the sensor support 160 is an arm that rotates about its longitudinal axis, the axis of rotation 165 can be parallel, e.g., collinear, with the longitudinal axis of the arm. For this configuration, when the arm rotates, the field of view 195 (and portion 190 being measured) sweeps perpendicular to the longitudinal axis of the arm. In some implementations, the sensor 180 is positioned on the sensor support 160 at position such that rotation about the axis 165 causes the field of view 195 (and the portion 190 measured) to sweep along a radius of the polishing pad 30 (shown by arrow C).

In some implementations, instead of or in addition to rotating about axis 165, the sensor 180 can rotate about an axis of rotation 185 that is parallel to the surface of the platen 24 but perpendicular to the arm. This can cause the field view 195 to sweep along the longitudinal axis of the sensor support 160. Again, this permits the sensor 180 to sweep the field of view 195 across the polishing pad 30 and measure the temperature of the polishing pad 30 at the portion 190 falling in the field of view 195.

In some implementations, the motor 170 can rotate the sensor support 160 about a vertical axis of rotation 175. As the motor 170 rotates the sensor support 160 about the axis 175, the sensor support 160 rotates about the axis 175, and the thermal sensor 180 can translate laterally across the polishing pad. This permits the sensor 180 to view different portions 190 of the polishing pad 30 as the motor 170 rotates about the axis 175. For example, if the sensor support 160 is an arm that is coupled to the motor 170, the arm can rotate about the axis 175 and cause the thermal sensor 180 to rotate about the axis 175 as well.

In some implementations, the thermal sensor 180 can move laterally along the sensor support 160. For example, if the sensor support 160 is an arm, the thermal sensor 180 can move along the arm (along the y-axis, as illustrated in FIG. 1A). For example, a linear actuator, e.g., a linear screw drive or a rack and pinion gear arrangement, could move the sensor 130 along the sensor support 160.

As the polishing pad 30 rotates about the axis 25, the thermal sensor 180 can measure the temperature of portions 190 at different portions 190 at different angular positions on the polishing pad 30. As the polishing pad 30 rotates about the axis 25, regions of the polishing pad 30 that may have been otherwise out of view of the thermal sensor 180 can come into the field of view 195 of the thermal sensor 180.

A controller 90 can be configured to receive the measurements from the sensor 180 and to operate the actuator(s) to control the position of the portion 190 being monitored. The field of view 195 one or more features of the temperature monitoring system 150. In some implementations, the controller 90 can cause an actuator to move the sensor support 160 up and down along the z-axis (as illustrated in FIG. 1A), thereby increasing or decreasing the space between the thermal sensor 180 and the polishing pad 30.

Additionally, the controller 90 can calculate a distance D from the thermal sensor 180 to the portion 190 on the polishing pad 30 based on an angle of the field of view 195 of the thermal sensor 180 and the vertical distance from the thermal sensor 180 to the polishing pad 30. The controller 90 can then similarly calculate the distance D' from the thermal sensor 180 to the portion 190' on the polishing pad 30 based on an angle of the field of view 195' of the thermal sensor 180 and the vertical distance from the thermal sensor 180 to the polishing pad 30. The distance D and D' can be used by the controller to compensate for changes to the signal strength due to the changing distance of the thermal sensor 180 from the portion 190 caused by rotation of the sensor 180. For example, the thermal radiation reaching the sensor 180 can vary according to an inverse-square law. The calculated distance can be used to normalize the signal strength to a standard distance so that the temperature calculation remains accurate as the distance varies.

The controller 90 can also determine at least the radial position relative to the axis of rotation 25 (and possibly both radial and angular position) of the field of view 195 on the polishing pad 30 based on the angle of the field of view 195. This calculation can take into account the position of the thermal sensor 180 relative to the polishing pad 30, e.g. as given by the rotational position of the platen 24, the position of the sensor support 160, and position of the sensor 160 along the sensor support 160. Subsequently, the controller 90 can determine which portion 190' of the polishing pad 30 is measured, and where the portion 190' is relative to the portion 190. With this information, the controller 90 can generate a temperature profile of the polishing pad 30 using the temperature measurement of the portion 190 of the polishing pad 30.

After the thermal sensor 180 measures the temperatures of the portions 190, 190' the controller 90 can combine the measured temperatures of the portions 190, 190' (and so on) to generate a temperature profile of the polishing pad 30. That is, the thermal sensor 180 measures the temperature of the portion 190 and then measures the temperature of the portion 190', taking into account the location of the portion 190' on the polishing pad 30 relative to the location of the portion 190 on the polishing pad 30 to generate a temperature profile (e.g., map the measured temperatures on the polishing pad 30) using the two portions 190 and 190'. This process can be repeated to measure the temperature of further portions of the polishing pad 30 such that the temperature profile of the polishing pad 30 can be generated.

In some implementations, the controller 90 uses the temperature profile generated by the temperature monitoring system 150 as feedback to control the temperature control system 100. For example, the temperature control system 100 can determine from the temperature profile generated by the temperature monitoring system 150 that there are portions 190 of the polishing pad 30 that are not at a desired temperature. The controller 90 can then cause the temperature control system 100 to deliver a temperature-controlled medium onto the portions 190 of the polishing pad 30 to raise or lower the measured temperature to a desired temperature.

As the thermal sensor 180 moves to sweep the field of view 195 radially and as the polishing pad 30 rotates about the axis 25, a "spiral" scan of different portions 190 the polishing pad 30 can be generated. This data can provide a radial temperature profile of the polishing pad 30. Alternatively, an aggregate of the multiple circular scans can generate a radial temperature profile of the polishing pad 30.

Figure 2A:
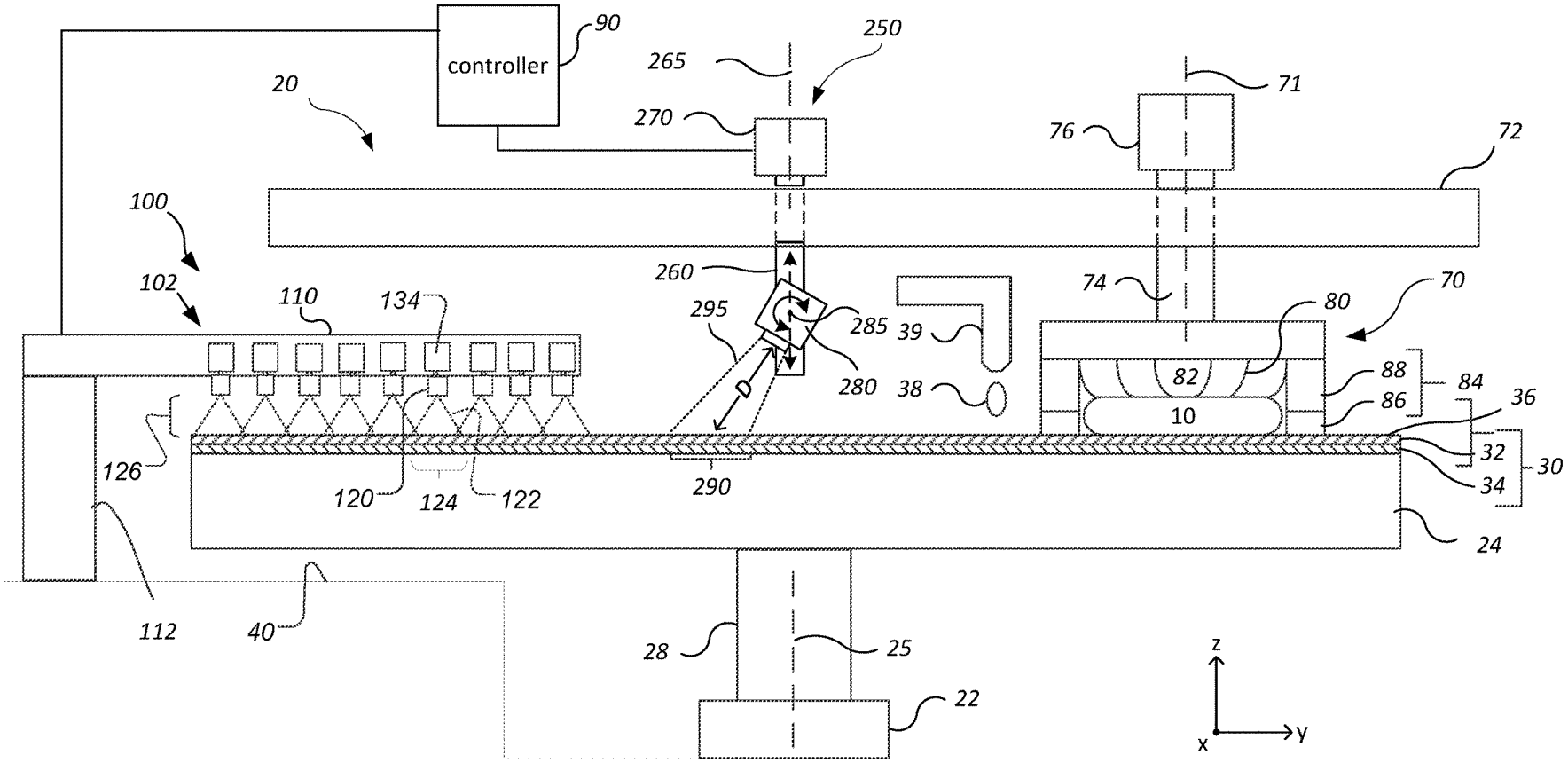
FIG. 2A is a schematic cross-sectional view of an example polishing apparatus.
Figure 2B:
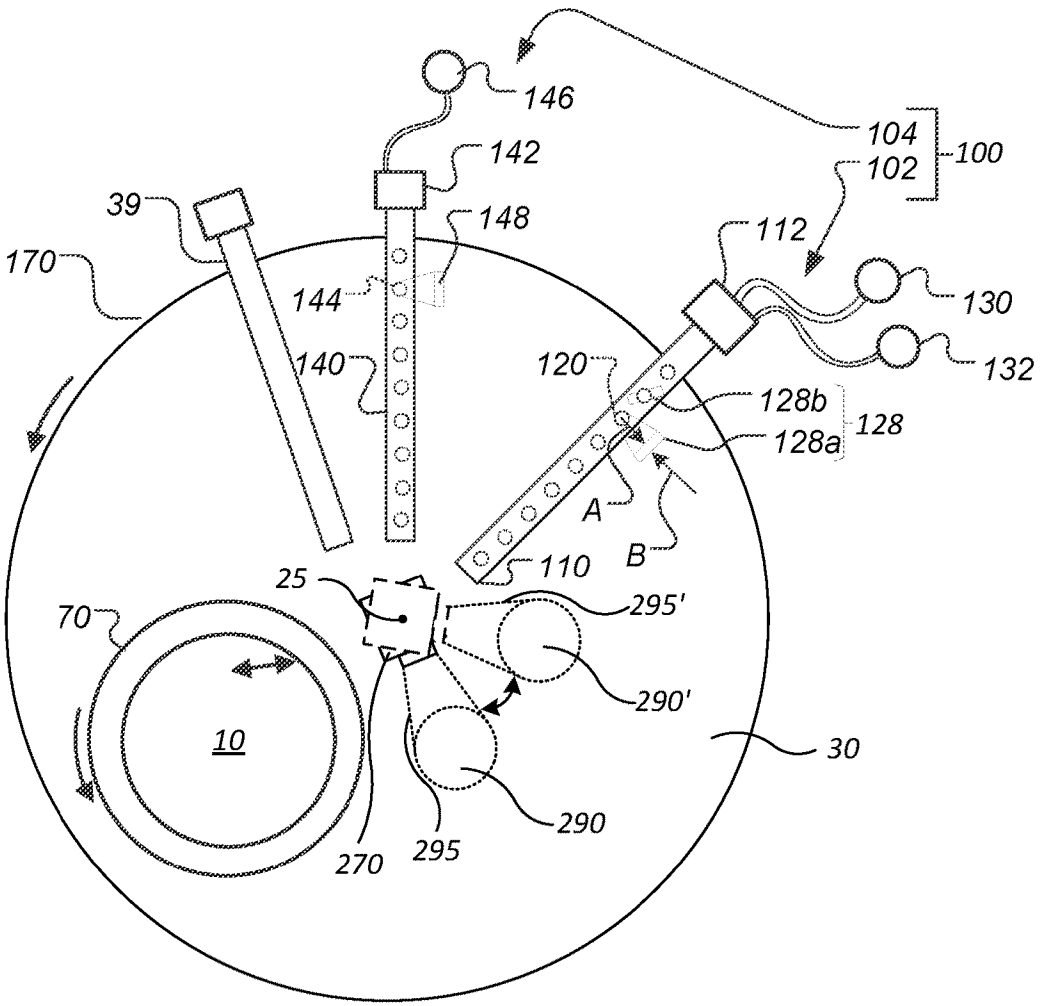
FIG. 2B is a schematic top view of the example polishing apparatus of FIG. 2A.

Referring to FIGS. 2A and 2B, the polishing station 20 has a temperature monitoring system 250. The temperature monitoring system 250 is similar to temperature monitoring system 150 described above, but the thermal sensor 280 is centrally located above the polishing pad 30. In particular, the thermal sensor 280 can be aligned with the axis of rotation 25 of the platen 40. The thermal sensor 280 has a field of view 295 of a portion 290 of the polishing pad 30.

The thermal sensor 280 can be rotatable so as to sweep the field of view 296 across different portions of the polishing pad 30.

The thermal sensor 280 can be supported by the support structure 72 using a sensor support 260. The thermal sensor 280 can be located above the center or substantially above the center of the polishing pad 30. The sensor support 260 or the sensor 280 is rotatable about an axis of rotation 265. For example, an arm that serves as the sensor support 260 could be rotatable by a motor 270 or the sensor 280 could be secured to the sensor support 260 by an actuator. This permits the sensor 280 to rotate to view different portions 290 at different angular positions on the polishing pad 30.

Assuming that the sensor support 260 is an arm that rotates about its longitudinal axis, the axis of rotation 265 is parallel, e.g., collinear, with the longitudinal axis of the arm. In some implementations, the axis of rotation 265 is perpendicular to the polishing surface 36 of the polishing pad 30. The axis of rotation 265 can be parallel to the axis of rotation 25 of the platen.

In some implementations, instead of or in addition to rotating about axis 265, the sensor 280 can rotate about an axis of rotation 285 that is parallel to the top surface of the platen 24 but perpendicular to the arm (and the axis 265). This can cause the field of view 295 to radially sweep across the polishing pad 30.

In some implementations, the thermal sensor 280 can move laterally along the sensor support 260, by having the sensor support 260 and the thermal sensor 280 move laterally along the z-axis (as illustrated in FIG. 2A). This permits the sensor 280 to increase or decrease the distance between the sensor 280 and the polishing pad 30.

By rotating about the axis 265, rotating about the axis 285, and/or moving laterally along the axis 265, the sensor 280 can first measure the temperature of the portion 290, then measure the temperature of another portion 290', and then generate a temperature profile of the polishing pad 30 comprising the multiple temperature measurements of the portions 290, 290', and so on.

The temperature profile or temperature map can be used as discussed above.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. The polishing layer can be a standard (for example, polyurethane with or without fillers) polishing material, a soft material, or a fixed-abrasive material.

Terms of relative positioning are used to refer to relative positioning within the system or substrate; it should be understood that the polishing surface and substrate can be held in a vertical orientation or some other orientation during the polishing operation.

Functional operations of the controller 90 can be implemented using one or more computer program products, i.e., one or more computer programs tangibly embodied in a non-transitory computer readable storage media, for execution by, or to control the operation of, data processing apparatus, e.g., a programmable processor, a computer, or multiple processors or computers.

A number of embodiments of the invention have been described. Nevertheless, it will be understood that various modifications may be made without departing from the spirit and scope of the invention. Accordingly, other embodiments are within the scope of the following claims.

What is claimed is:

1. A chemical mechanical polishing apparatus comprising:

a platen having a top surface to hold a polishing pad;

a carrier head to hold a substrate against a polishing surface of the polishing pad during a polishing process;

a temperature monitoring system including a non-contact thermal sensor positioned above the platen to have a field of view of a portion of the polishing pad on the platen, the thermal sensor rotatable by a motor about an axis of rotation parallel to the polishing surface so as to move the field of view across the polishing pad.

2. The apparatus of claim 1, comprising a rotatable sensor support coupled to the motor such that rotation of the support by the motor rotates the sensor.

3. The apparatus of claim 2, wherein the sensor support comprises an arm extending over the polishing pad.

4. The apparatus of claim 2, wherein the thermal sensor is movable along the support.

5. The apparatus of claim 2, wherein the sensor support is rotatable about a longitudinal axis of the sensor support.

6. The apparatus of claim 1, wherein the temperature monitoring system is configured to measure a temperature of the portion of the polishing pad.

7. The apparatus of claim 1, further comprising a controller coupled to the motor and the temperature monitoring system and configured to control the motor so as to cause the thermal sensor to make measurements at a plurality of positions on the polishing pad.

8. The apparatus of claim 7, wherein the controller is configured to generate a temperature profile of the polishing pad based on measurements at the plurality of positions on the polishing pad.

9. The apparatus of claim 8, further comprising a heater and/or cooler, and wherein the controller is configure to adjust operation of the heater and/or cooler based on the temperature profile so as to improve temperature uniformity of the polishing pad.

10. The apparatus of claim 8, wherein the temperature profile is a radial profile.

11. The apparatus of claim 8, wherein the temperature profile is an angular profile about an axis of rotation of the platen.

12. The apparatus of claim 8, wherein the temperature profile is a 2D profile.

13. The apparatus of claim 1, wherein the thermal sensor is positioned centered on an axis of rotation of the platen.

14. The apparatus of claim 13, wherein the axis of rotation of the thermal sensor is parallel to the axis of rotation of the platen.

15. The apparatus of claim 13, wherein the axis of rotation of the thermal sensor is parallel to the polishing surface.

16. A chemical mechanical polishing apparatus comprising:

a platen having a top surface to hold a polishing pad;

a carrier head to hold a substrate against a polishing surface of the polishing pad during a polishing process;

a temperature monitoring system including a non-contact thermal sensor positioned above the platen to have a field of view of a portion of the polishing pad on the platen, the thermal sensor rotatable by a motor about an axis of rotation so as to move the field of view across the polishing pad; and a rotatable sensor support coupled to the motor such that rotation of the support by the motor rotates the sensor, wherein the thermal sensor is rotatable about an axis perpendicular to a longitudinal axis of the support.

17. A method of monitoring a temperature of a polishing pad in a chemical mechanical polishing system, comprising:

rotating a thermal sensor about an axis of rotation such that a field of view of the thermal sensor sweeps across a polishing surface of a chemical mechanical polishing pad while the thermal sensor remains laterally stationary; and as the field of view sweeps across the polishing pad, making a plurality of measurements with the thermal sensor to generate a temperature profile.

18. The method of claim 17, wherein the axis of rotation is parallel to the polishing surface.

19. The method of claim 17, wherein the axis of rotation is perpendicular to the polishing surface.

* * * * *